US011246349B2

(12) United States Patent
Ouyang

(10) Patent No.: US 11,246,349 B2
(45) Date of Patent: Feb. 15, 2022

(54) ATOMIZING DEVICE AND ELECTRONIC CIGARETTE HAVING SAME

(71) Applicant: SHENZHEN IVPS TECHNOLOGY CO., LTD., Shenzhen (CN)

(72) Inventor: Junwei Ouyang, Shenzhen (CN)

(73) Assignee: SHENZHEN IVPS TECHNOLOGY CO., LTD., Guangdong (CN)

( * ) Notice: Subject to any disclaimer, the term of this patent is extended or adjusted under 35 U.S.C. 154(b) by 392 days.

(21) Appl. No.: 16/234,067

(22) Filed: Dec. 27, 2018

(65) Prior Publication Data

US 2020/0128881 A1 Apr. 30, 2020

(30) Foreign Application Priority Data

Oct. 25, 2018 (CN) ..... 201821734902.8

(51) Int. Cl.
*A24F 40/485* (2020.01)

(52) U.S. Cl.
CPC ..... *A24F 40/485* (2020.01)

(58) Field of Classification Search
CPC .. A61M 15/06; A61M 11/042; A61M 11/044; A24F 47/008; A24F 40/485
See application file for complete search history.

(56) References Cited

U.S. PATENT DOCUMENTS 5,404,891 A * 4/1995 Kiribuchi ..... A24D 1/10 131/337
9,463,475 B2 * 10/2016 Westendarp ..... B04B 11/04
9,538,790 B2 * 1/2017 Li ..... A61M 15/06
9,788,576 B2 * 10/2017 Liu ..... A24F 40/485
10,653,186 B2 * 5/2020 Verleur ..... A24F 40/42
2013/0192617 A1 * 8/2013 Thompson ..... A24F 40/46 131/329
2013/0213419 A1 * 8/2013 Tucker ..... H05B 3/0014 131/328
2014/0060529 A1 * 3/2014 Zhang ..... A24F 40/42 128/202.21

(Continued)

FOREIGN PATENT DOCUMENTS

CN 105054311 A 11/2015
CN 105927772 A 9/2016

(Continued)

*Primary Examiner* — Marcus E Harcum
(74) *Attorney, Agent, or Firm* — IP-Pal Patent US; Klaus Michael Schmid

(57) ABSTRACT

The invention discloses an atomizing device of electronic cigarette and an electronic cigarette having same. The atomizing device comprises a main body, a heating device and a waterproof and breathable membrane, wherein the main body is provided with an air inlet, a suction port and an oil storage chamber, the main body forms an airflow channel between the air inlet and the suction port, the heating device is partially received in the airflow channel and is communicated with the oil storage chamber, the waterproof and breathable membrane is installed on the main body, and the waterproof and breathable membrane covers the airflow channel between the air inlet and the heating device. The technical scheme of the invention effectively prevents the phenomenon that tobacco liquid and condensed water leak out of the air inlet so as to cause damage to external components.

7 Claims, 5 Drawing Sheets

(56) References Cited

U.S. PATENT DOCUMENTS

| | | | | |
|---|---|---|---|---|
| 2014/0069425 | A1* | 3/2014 | Zhang | A24F 47/008 128/202.21 |
| 2016/0073692 | A1 | 3/2016 | Alarcon et al. | |
| 2016/0286858 | A1 | 10/2016 | Liu | |
| 2016/0345625 | A1* | 12/2016 | Liu | A24F 47/008 |
| 2017/0027221 | A1* | 2/2017 | Liu | B65D 85/70 |
| 2017/0049154 | A1* | 2/2017 | Batista | A24F 40/42 |
| 2017/0071249 | A1* | 3/2017 | Ampolini | A24F 47/008 |
| 2017/0360092 | A1* | 12/2017 | Althorpe | A24F 40/44 |
| 2018/0154092 | A1* | 6/2018 | Patoret | A61M 15/06 |
| 2018/0206555 | A1 | 7/2018 | Chen | |
| 2018/0220707 | A1* | 8/2018 | Biel | A61M 11/042 |
| 2018/0289066 | A1* | 10/2018 | Mo | A24F 40/50 |
| 2018/0360115 | A1* | 12/2018 | Lin | A61M 15/0066 |
| 2019/0124983 | A1* | 5/2019 | Rogers | A61M 15/06 |
| 2019/0166913 | A1* | 6/2019 | Trzecieski | A24F 40/49 |

FOREIGN PATENT DOCUMENTS

| | | | |
|---|---|---|---|
| CN | 206213290 | U | 6/2017 |
| CN | 206714076 | U | 12/2017 |
| EP | 3360431 | A2 | 8/2018 |
| WO | 201444678 | A2 | 9/2014 |
| WO | 2015165812 | A1 | 11/2015 |

* cited by examiner

ATOMIZING DEVICE AND ELECTRONIC CIGARETTE HAVING SAME

TECHNICAL FIELD

The invention relates to an atomizing device of an electronic cigarette and an electronic cigarette having same.

BACKGROUND

Electronic cigarettes, also known as electronic cigarettes, are mainly used to quit smoking and replace conventional cigarettes. It has an appearance and taste similar to conventional cigarettes, and even has more tastes than conventional cigarettes. It can generate smoke, a taste and a feel like conventional cigarettes. Since electronic cigarettes have no tar, suspension particles and other harmful components in conventional cigarettes and are popular among consumers, electronic cigarettes have gradually replaced conventional cigarettes in the market However, in the existing atomizing device of an electronic cigarette, because the main body forms an airflow channel between the air inlet and the air outlet during operation, the heating device is partially received in the airflow channel. Therefore, in the atomizing process, if the air inlet is located below the heating device, the tobacco tar absorbed by the heating device from the oil storage chamber will easily flow out along the air inlet under the action of gravity, resulting in oil leakage.

SUMMARY

The main purpose of the invention is to provide an atomizing device of an electronic cigarette, which aims to prevent the phenomenon that tobacco liquid and condensed water leak out of the air inlet so as to cause damage to external components.

In order to achieve the above object, the invention provides an atomizing device of an electronic cigarette, comprising a main body, a heating device and a waterproof and breathable membrane, wherein the main body is provided with an air inlet, a suction port and an oil storage chamber, the main body forms an airflow channel between the air inlet and the suction port, the heating device is partially received in the airflow channel and is communicated with the oil storage chamber, the waterproof and breathable membrane is installed on the main body, and the waterproof and breathable membrane covers the airflow channel between the air inlet and the heating device.

Preferably, the waterproof and breathable membrane comprises a base material with waterproof and breathable properties and an anti-wrinkle ring, the anti-wrinkle ring covers the edge of the base material so that when the base material is installed on the main body, the part of the base material not covered by the anti-wrinkle ring covers the airflow channel and forms a breathable part, and the breathable part is communicated with the airflow channel through an air path.

Preferably, the main body comprises a base body and a chassis; the air inlet is provided on the chassis, the airflow channel forms an air passage hole communicated with the air inlet on the outer surface of the chassis, the chassis is further provided with an installing groove on the periphery of the air passage hole, the waterproof breathable membrane is installed on the installing groove, and the breathable part of the waterproof breathable membrane covers the air passage hole so that the breathable part is communicated with the air passage hole through an air path; the suction port, the oil storage chamber and the heating device are received in the base body, the base body covers the installing groove when being installed on the chassis, and the heating device is communicated with the breathable part of the waterproof and breathable membrane.

Preferably, the thickness of the waterproof and breathable membrane is larger than or equal to the depth of the installing groove, and when being installed on the chassis, the base body abuts against the anti-wrinkle ring to press the waterproof and breathable membrane into the installing groove.

Preferably, the thickness of the waterproof and breathable membrane is less than or equal to the depth of the installing groove, and the waterproof and breathable membrane further comprises an adhesive layer which is provided on the surface of the base material facing away from the anti-wrinkle ring so that the base material is adhered to the inner groove wall of the installing groove.

Preferably, the thickness of the waterproof and breathable membrane is less than the depth of the installing groove, the outer peripheral surface of the waterproof and breathable membrane is spaced from the inner peripheral wall of the installing groove, and the waterproof and breathable membrane is separated from the inner groove wall of the installing groove under the urging force of air flow, which is drawn through the air inlet, so that the air passage hole is communicated with the installing groove.

Preferably, the difference between the thickness of the waterproof and breathable membrane and the depth of the installing groove is in the range from 1 mm to 2 mm, so that the maximum distance, in which the waterproof and breathable membrane is separated from the inner groove wall of the installing groove under the urging force of air flow drawn through the air inlet, has a value of 1 mm to 2 mm; and/or the thickness of the base material has a value of 0.1 mm to 0.5 mm.

Preferably, the chassis is further provided with at least one stopper, one end of the at least one stopper is fixed to the chassis and the other end thereof is placed in the notch of the installing groove, and the waterproof and breathable membrane abuts against the at least one stopper when moving outside the installing groove under the urging force of the airflow.

Preferably, one of the waterproof and breathable membrane and the chassis is provided with a positioning member and the other thereof is correspondingly provided with a positioning groove, and when the waterproof and breathable membrane is installed in the installing groove, the positioning member is inserted into the positioning groove.

The invention further provides an electronic cigarette which comprises an atomizing device, wherein the atomizing device comprises a main body, a heating device and a waterproof and breathable membrane, wherein the main body is provided with an air inlet, a suction port and an oil storage chamber, the main body forms an airflow channel between the air inlet and the suction port, the heating device is partially received in the airflow channel and is communicated with the oil storage chamber, the waterproof and breathable membrane is installed on the main body, and the waterproof and breathable membrane covers the airflow channel between the air inlet and the heating device.

According to the atomizing device of the electronic cigarette of the technical scheme of the invention, a waterproof and breathable membrane is provided between the heating device and the air inlet to cover the airflow channel. The external airflow may enter the heating device through the waterproof and breathable membrane to provide airflow for the normal operation of the heating device. When the electronic cigarette is idle and unused, the tobacco liquid leaking out of the heating device is blocked by the waterproof and breathable membrane and cannot leak out of the air inlet, effectively preventing the phenomenon that tobacco liquid leaks out of the air inlet so as to cause damage to external components.

BRIEF DESCRIPTION OF THE DRAWINGS

For a better illustration of the embodiments of the invention or the technical solution in the prior art, accompanying drawings needed in the description of the embodiments or the prior art are simply illustrated below. Obviously, the accompanying drawings described below are some embodiments of the invention. For those skilled in the art, other accompanying drawings may be obtained according to the structure shown in these accompanying drawings without creative work.

DESCRIPTION OF THE REFERENCE NUMBERS

Figure 1:
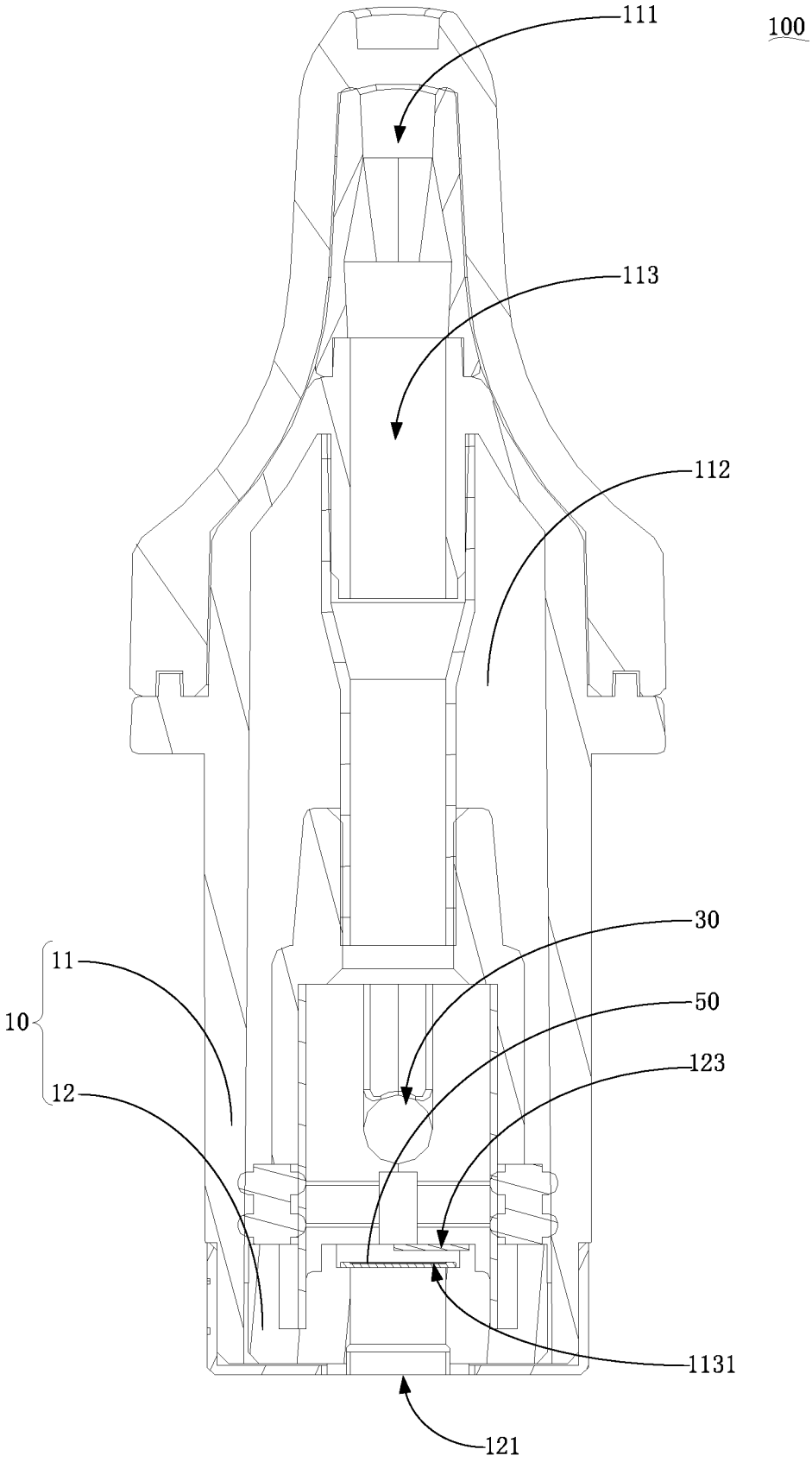
FIG. 1 is a schematic cross-sectional diagram illustrating connecting structure of an atomizing device of an electronic cigarette according to the invention.

| Reference number | Name of part | Reference number | Name of part |
|---|---|---|---|
| 100 | atomizing device | 123 | stopper |
| 10 | main body | 124 | positioning member |
| 11 | base body | 30 | heating device |
| 111 | suction port | 50 | waterproof and breathable membrane |
| 112 | oil storage chamber | 51 | base material |
| 113 | airflow channel | 511 | breathable part |
| 1131 | air passage hole | 52 | anti-wrinkle ring |
| 12 | chassis | 53 | adhesive layer |
| 121 | air inlet | 54 | positioning groove |
| 122 | installing groove | | |

The implementation of aims, the function features and the advantages of the invention are described below in further detail in conjunction with embodiments with reference to the drawings.

DESCRIPTION OF THE EMBODIMENTS

A clear and complete description as below is provided for the technical solution in the embodiments of the invention in conjunction with the drawings in the embodiments of the invention. Obviously, the embodiments described hereinafter are simply part embodiments of the invention, rather than all the embodiments. All other embodiments obtained by those skilled in the art based on the embodiments in the invention without creative work are intended to be included in the scope of protection of the invention.

It should be noted that all directional indications (such as top, bottom, left, right, front, behind . . . ) in the embodiments of the invention are merely to illustrate a relative position relation, a relative motion condition, etc. between each part in a certain state (for example, the state shown in the drawings). If the state changes, the directional indication changes accordingly.

In addition, if terms "first", "second", etc. appear in the invention, they are merely for the purpose of description, but cannot be understood as the indication or implication of relative importance or as the implicit indication of the number of the designated technical features; therefore, features defined by "first" and "second" may specifically or implicitly comprise at least one such feature. In addition, technical solutions of each embodiment of the invention may be combined mutually; however, this must be carried out on the basis that those skilled in the art can implement the combination. When the combination of technical solutions has a conflict or cannot be implemented, it should be considered that such combination of technical solutions does not exist and is not in the scope of protection claimed by the invention.

In the invention, unless otherwise specifically stated and defined, terms "connected", "fixed", etc. should be interpreted expansively. For example, "fixed" may be fixed connection, detachable connection, or integration; may be mechanical connection or electrical connection; direct connection, indirect connection through an intermediate, or internal communication between two elements or interaction of two elements, unless otherwise specifically defined. Those skilled in the art can understand the specific implication of the above terms in the invention according to specific conditions.

The invention provides an electronic cigarette (not shown), which includes an atomizing device 100 and a battery device (not shown) for supplying power to the atomizing device 100. The battery device is internally provided with a power supply, a controller, a control key or an airflow sensor. The controller receives a control signal transmitted by the control key or the airflow sensor to supply power to the atomizing device 100. The atomizing device 100 is internally provided with an oil storage chamber 112 for storing tobacco liquid or tobacco products and a heating device 30. When the heating device 30 is driven by the current of the battery device, a high temperature is generated to atomize the tobacco liquid absorbed by the heating device from the oil storage chamber 112, thereby generating smoke which is then discharged through the suction port 111 for the user to smoke. Here, the pneumatic sensor may select a negative pressure gas sensor switch and package the circuit board integrated inside the battery device of the electronic cigarette through the SOT-23-5 technology. When the user smokes, the gas in the inner chamber is drawn out of the airflow channel 113, thus generating an air pressure difference. When the generated air pressure difference reaches a preset threshold, the negative pressure sensor is triggered to enable the battery device to supply power to the atomizing device 100. There is no need to control by physical keys, which is convenient for users to manipulate. The S087 negative pressure gas sensor switch is used here, in which the detection accuracy is −400 Pa, the trigger sensitivity is high, the static current is less than 5 uA in the power saving mode, the peripheral application circuit is simple, the volume is small and the cost is low.

Referring to FIGS. 1 to 5, the atomizing device comprises a main body 10, a heating device 30 and a waterproof and breathable membrane 50, wherein the main body 10 is provided with an air inlet 121, a suction port 111 and an oil storage chamber 112, the main body 10 forms an airflow channel 113 between the air inlet 121 and the suction port 111, the heating device 30 is partially received in the airflow channel 113 and is communicated with the oil storage chamber 112, the waterproof and breathable membrane 50 is installed on the main body 10, and the waterproof and breathable membrane 50 covers the airflow channel 113 between the air inlet 121 and the heating device 30.

According to the atomizing device 100 of the electronic cigarette of the technical scheme of the invention, a waterproof and breathable membrane 50 is provided between the heating device 30 and the air inlet 121 to cover the airflow channel 113. The external airflow may enter the heating device 30 through the waterproof and breathable membrane 50 to provide airflow for the normal operation of the heating device 30. When the electronic cigarette is idle and unused, the tobacco liquid leaking out of the heating device 30 is blocked by the waterproof and breathable membrane 50 and cannot leak out of the air inlet 121, effectively preventing the phenomenon that tobacco liquid leaks out of the air inlet 121 so as to cause damage to external components.

Figure 5:
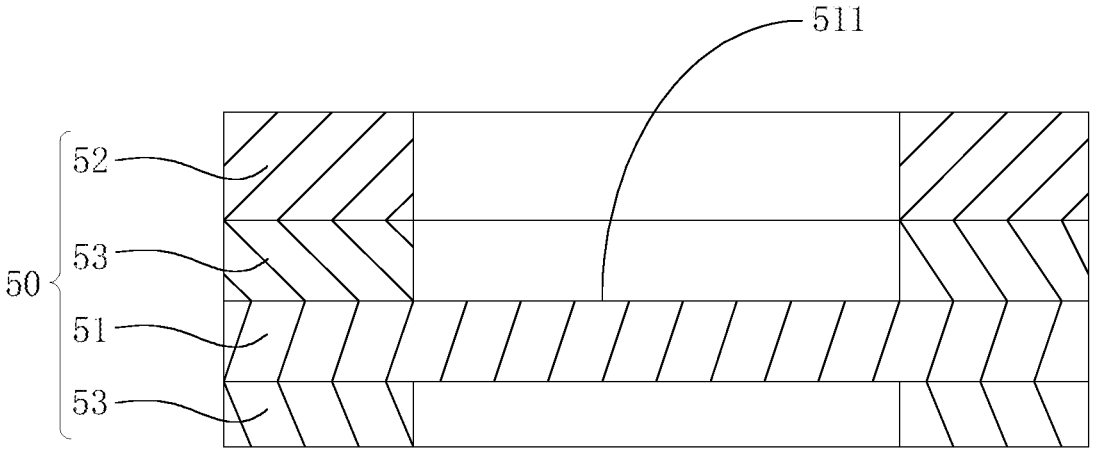
FIG. 5 is a schematic cross-sectional diagram illustrating a connection structure of a waterproof and breathable membrane according to the invention.

Specifically, as shown in FIG. 5, in the embodiment of the invention, the waterproof and breathable membrane 50 comprises a base material 51 with waterproof and breathable properties and an anti-wrinkle ring 52, the anti-wrinkle ring 52 covers the edge of the base material 51 so that when the base material 51 is installed on the main body 10, the part of the base material 51 not covered by the anti-wrinkle ring 52 covers the airflow channel 113 and forms a breathable part 511, and the breathable part 511 is communicated with the airflow channel 113 through an air path. Here, the base material 51 is made of a TPU membrane or a high molecular breathable membrane such as polytetrafluoroethylene, and the anti-wrinkle ring 52 is made of materials such as non-toxic silica gel and polyethylene terephthalate and is fixed to the base material 51 by gluing, so that the base material 51 has a certain tension, preventing the phenomenon of wrinkling. At the same time, the base material 51 not covered by the anti-wrinkle ring 52 forms a breathable part 511 through which gas in the airflow channel 113 circulates.

Figure 2:
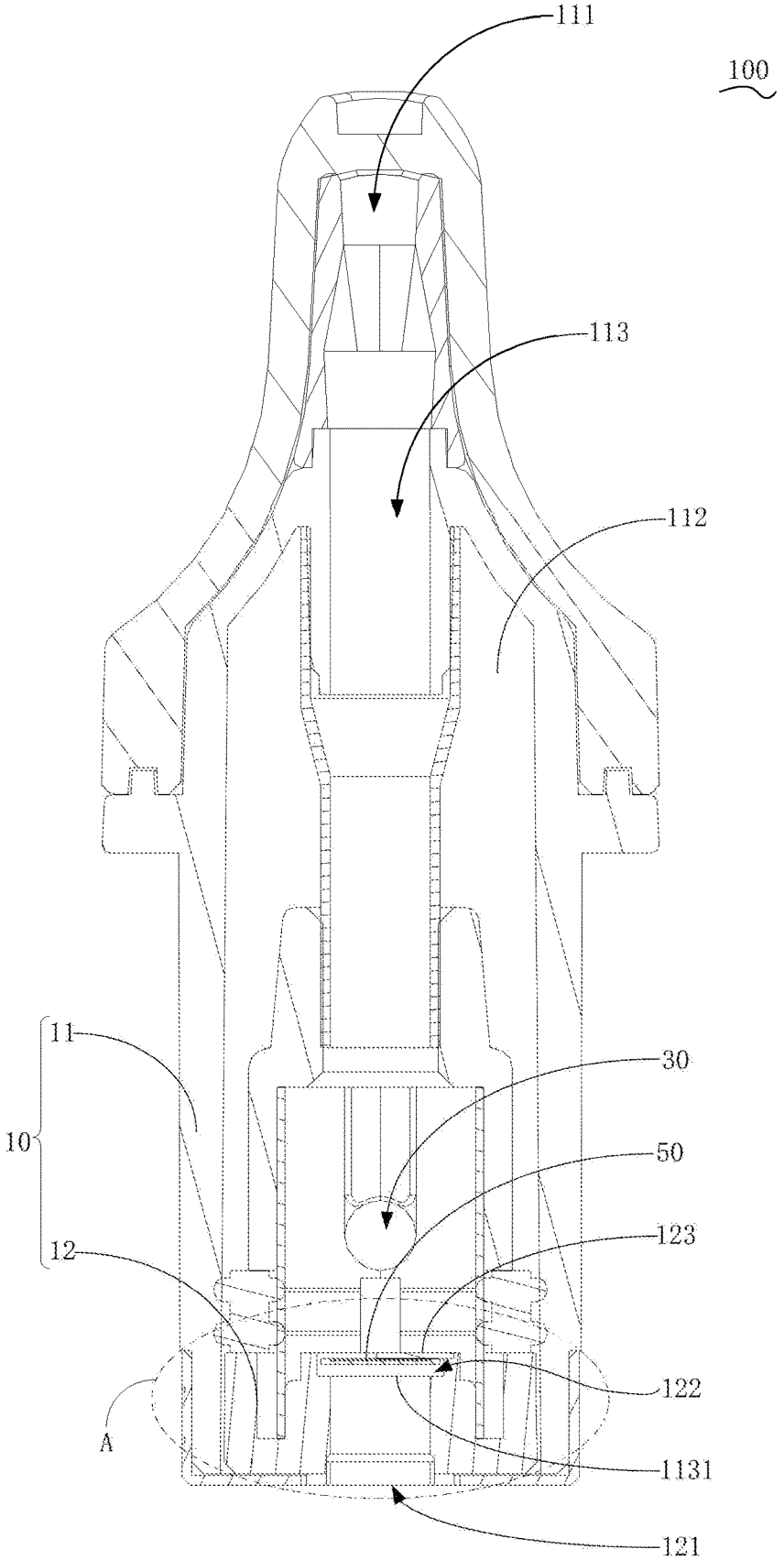
FIG. 2 is a schematic cross-sectional diagram illustrating connecting structure of a waterproof and breathable membrane separated from an inner wall of an installing groove under the urging force of the airflow according to the invention.
Figure 3:
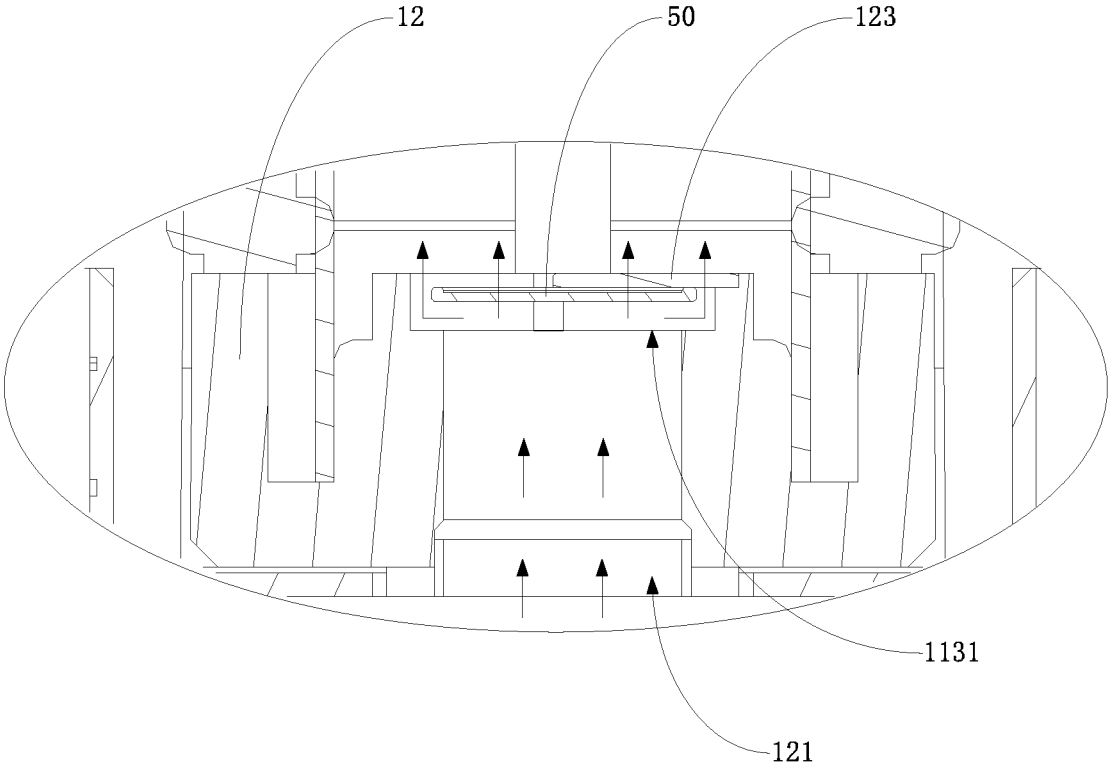
FIG. 3 is a partially enlarged schematic diagram at A in FIG. 2 according to the invention.

Specifically, as shown in FIG. 1 or FIG. 2, in the embodiment of the invention, the main body 10 comprises a base body 11 and a chassis 12; the air inlet 121 is provided on the chassis 12, the airflow channel 113 forms an air passage hole 1131 communicated with the air inlet 121 on the outer surface of the chassis 12, the chassis 12 is further provided with an installing groove 122 on the periphery of the air passage hole 1131, the waterproof breathable membrane 50 is installed on the installing groove 122, and the breathable part 511 of the waterproof breathable membrane 50 covers the air passage hole 1131 so that the breathable part 511 is communicated with the air passage hole 1131 through an air path; the suction port 111, the oil storage chamber 112 and the heating device 30 are received in the base body 11, the base body 11 covers the installing groove 122 when being installed on the chassis 12, and the heating device 30 is communicated with the breathable part 511 of the waterproof and breathable membrane 50. Here, in the present embodiment, the chassis 12 is detachably installed on the base body 11. When the chassis 12 is detached from the base body 11, the installing groove 122 is exposed to the outside, and the user may clean or replace the surface of the waterproof and breathable membrane 50. When the chassis 12 is installed on the base body 11, the heating device 30 and the air inlet 121 are both communicated with the breathable part 511 through an air path for the normal suction by the user. The phenomenon that the breathability effect is weakened due to more stains adhered to the waterproof and breathable membrane 50 during long-term use is effectively prevented.

Specifically, in a first embodiment of the invention, the thickness of the waterproof and breathable membrane 50 is larger than or equal to the depth of the installing groove 122, and when being installed on the chassis 12, the base body 11 abuts against the anti-wrinkle ring 52 to press the waterproof and breathable membrane 50 into the installing groove 122. Here, the thickness of the waterproof and breathable membrane 50 is larger than or equal to the depth of the installing groove 122. When being fixed to the base body 11 in a manner of being snap-fit with the base body 11 by means of threads, interference fit or buckling, the chassis 12 abuts against the anti-wrinkle ring 52 of the waterproof and breathable membrane 50 to press the waterproof and breathable membrane 50 into the installing groove 122, effectively preventing the phenomenon that the waterproof and breathable membrane 50 shakes or is lost.

Specifically, one end of the chassis 12 is screwed to the base body 11. Because if the waterproof and breathable membrane 50 is higher than the notch plane of the installing groove 122 during rotation, the notch plane will scratch the outer surface of the waterproof and breathable membrane 50, the waterproof and breathable membrane 50 will be easily damaged during long-term use. Therefore, in a second embodiment of the invention, the thickness of the waterproof and breathable membrane 50 is less than or equal to the depth of the installing groove 122, and the waterproof and breathable membrane 50 further comprises an adhesive layer 53 which is provided on the surface of the base material 51 facing away from the anti-wrinkle ring 52 so that the base material 51 is adhered to the inner groove wall of the installing groove 122. Here, the manner in which the waterproof and breathable membrane 50 is effectively prevented from falling off by providing an adhesive layer 53 and the waterproof and breathable membrane 50 is effectively prevented from rubbing against external components so as to be damaged also falls within the scope of protection of the invention.

Figure 4:
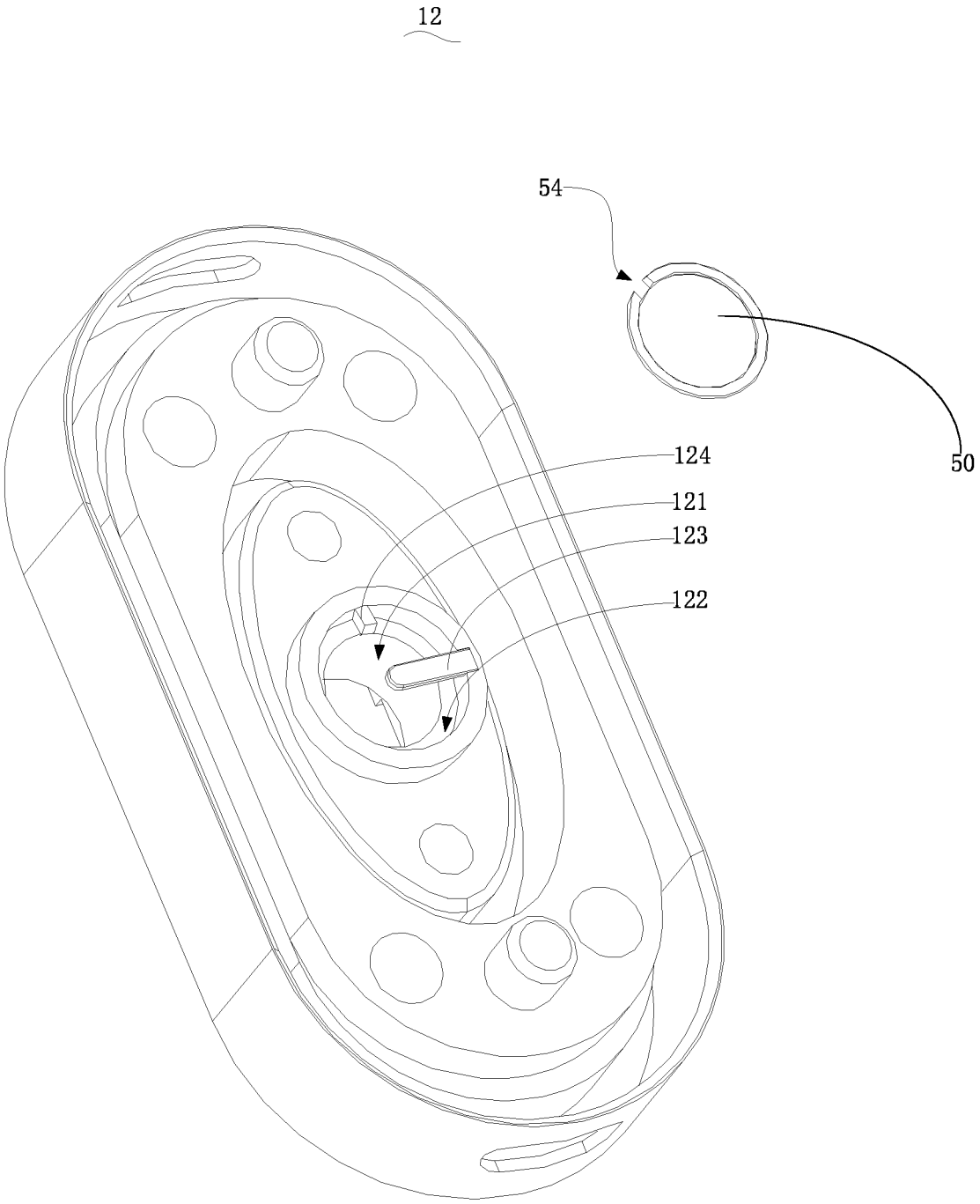
FIG. 4 is an exploded schematic diagram illustrating connection structure of a waterproof and breathable membrane installed on a chassis according to the invention.

Specifically, as shown in FIGS. 1 to 4, in the embodiment of the invention, the amount of smoke required by the user is large in the actual application process. At this time, when the breathability effect of the existing waterproof and breathable membrane 50 cannot be satisfied, the invention proposes a fourth embodiment, in which:

the thickness of the waterproof and breathable membrane 50 is less than the depth of the installing groove 122, the outer peripheral surface of the waterproof and breathable membrane 50 is spaced from the inner peripheral wall of the installing groove 122, and the waterproof and breathable membrane 50 is separated from the inner groove wall of the installing groove 122 under the urging force of airflow, which is drawn through the air inlet 121, so that the air passage hole 1131 is communicated with the installing groove 122. Here, the size of the installing groove 122 is larger than the size of the waterproof and breathable membrane 50 so that the outer peripheral surface of the waterproof and breathable membrane 50 is spaced from the inner peripheral wall of the installing groove 122. At the same time, the thickness of the waterproof and breathable membrane 50 is less than the depth of the installing groove 122. Therefore, the waterproof and breathable membrane 50 is completely received in the installing groove 122 provided on the chassis 12 and is movable along the installing groove 122 to form a floating diaphragm. When the user smokes, as shown in FIG. 4, the arrow in the figure indicates the trajectory direction along which the air flows. The airflow is drawn in from the air inlet 121 to push the waterproof and breathable membrane 50 away from the inner groove wall of the installing groove 122, so that the air passage hole 1131 is directly communicated with the air path of the installing groove 122 and then is communicated with the heating device 30 through the air path, effectively satisfying the demand of the user for a large amount of smoke. At the same time, in the process of smoking, the external airflow flows at a high speed between the waterproof and breathable membrane 50 and the inner groove wall of the installing groove 122. Under the action of air pressure, the tobacco liquid cannot leak out of the gap there between to the air inlet 121, effectively preventing the phenomenon that the tobacco liquid leaks out when the air passage hole 1131 is in direct communication with the airflow channel 113. When the user stops smoking, the waterproof and breathable membrane 50 falls under the action of gravity to cover the air passage hole 1131, thereby preventing the tobacco liquid from leaking to the air inlet 121 through the air passage hole 1131.

Specifically, the difference between the thickness of the waterproof and breathable membrane 50 and the depth of the installing groove 122 is in the range from 1 mm to 2 mm, so that the maximum distance, in which the waterproof and breathable membrane 50 is separated from the inner groove wall of the installing groove 122 under the urging force of the airflow drawn through the air inlet 121, has a value of 1 mm to 2 mm; and/or the thickness of the base material 51 has a value of 0.1 mm to 0.5 mm. Here, in the present embodiment, the difference between the thickness of the waterproof and breathable membrane 50 and the depth of the installing groove 122 is 1 mm, effectively preventing the phenomenon that the existing waterproof and breathable membrane 50 has insufficient breathability effect, and preventing the phenomenon that the floating distance value of the waterproof and breathable membrane 50 is larger, resulting in weaker airflow pressure and leakage of leaked tobacco liquid from the gap between the waterproof and breathable membrane 50 and the air passage hole 1131. Alternatively, there is a phenomenon of a large product volume. Similarly, the thickness of the base material 51 has a value of 0.1 mm to 0.5 mm. In the present embodiment, the thickness of the base material 51 has a value of 0.15 mm, and the membrane is thin, effectively ensuring that the waterproof and breathable membrane 50 can be separated from the inner groove wall of the installing groove 122 under the urging force of the airflow when the user smokes, so that the air passage hole 1131 is in direct communication with the installing groove 122.

Further, as shown in FIGS. 1 to 4, in the embodiment of the invention, the chassis 12 is further provided with at least one stopper 123, one end of the at least one stopper 123 is fixed to the chassis 12 and the other end thereof is placed in the notch of the installing groove 122, and the waterproof and breathable membrane 50 abuts against the at least one stopper 123 when moving outside the installing groove 122 under the urging force of the airflow. Here, in the present embodiment, the base body 11 is further provided with a stopper 123 made of elastic silica gel sheet. One end of the stopper 123 is fixed to the chassis 12, and the other end thereof is suspended in the notch of the installing groove 122 to form an elastic cantilever. During installation, the user pushes the elastic cantilever aside, installs the waterproof and breathable membrane 50 in the installing groove 122, and then releases the pressure applied to the elastic cantilever. The elastic cantilever restores the elastic deformation and is suspended in the notch of the installing groove 122 to prevent the waterproof and breathable membrane 50 from being separated from the installing groove 122.

It is to be understood that in the actual application process, it is not limited to the above manner in which a stopper 123 is used to form a cantilever. For example, in other embodiments of the invention, the manner in which a plurality of stoppers 123 are used or one end of the stopper 123 is fixed to the chassis 12 and the other end thereof crosses the notch of the installing groove 122 and overlaps the other end of the installing groove 122 also falls within the scope of protection of the invention.

Further, as shown in FIG. 4, in the embodiment of the invention, one of the waterproof and breathable membrane 50 and the chassis 12 is provided with a positioning member 124 and the other thereof is correspondingly provided with a positioning groove 54, and when the waterproof and breathable membrane 50 is installed in the installing groove 122, the positioning member 124 is inserted into the positioning groove 54. Here, in the present embodiment, the positioning member 124 and the positioning groove 54 are provided, effectively preventing the phenomenon that the waterproof and breathable membrane 50 deflects during the floating process when the gap between the waterproof and breathable membrane 50 and the side groove wall of the installing groove 122 is large so as to not completely cover the air passage hole 1131.

The invention further provides an electronic cigarette, which comprises a battery device and an atomizing device 100 of an electronic cigarette. Refer to the above embodiment for the specific structure of the atomizing device 100 of the electronic cigarette. Due to the use of all the technical solutions of all the above embodiments, the electronic cigarette has at least all the beneficial effects brought by the technical solutions of the above embodiments, which will not be described in detail herein.

The above are preferred embodiments of the invention merely and are not intended to limit the patent scope of the invention. Any equivalent structures made according to the description and the accompanying drawings of the invention without departing from the idea of the invention, or any equivalent structures applied in other relevant technical fields directly or indirectly are intended to be included in the patent protection scope of the invention.

What is claimed is:

1. An atomizing device of an electronic cigarette, comprising a main body, a heating device and a waterproof and breathable membrane, wherein the main body is provided with an air inlet, a suction port and an oil storage chamber, the main body forms an airflow channel between the air inlet and the suction port, the heating device is partially received in the airflow channel and is communicated with the oil storage chamber, the waterproof and breathable membrane is installed on the main body, and the waterproof and breathable membrane covers the airflow channel between the air inlet and the heating device;

wherein the waterproof and breathable membrane comprises a base material with waterproof and breathable properties and an anti-wrinkle ring, the anti-wrinkle ring covers a edge of the base material so that when the base material is installed on the main body, a part of the base material not covered by the anti-wrinkle ring covers the airflow channel and forms a breathable cart, and the breathable cart is communicated with the airflow channel through an air path;

wherein the main body comprises a base body and a chassis: the air inlet is provided on the chassis, the airflow channel forms an air passage hole communicated with the air inlet on an outer surface of the chassis, the chassis is further provided with an installing groove on a periphery of the air passage hole, the waterproof breathable membrane is installed in the installing groove, and the breathable part of the waterproof breathable membrane covers the air passage hole so that the breathable part is communicated with the air passage hole through the air path; and the suction port, the oil storage chamber and the heating device are received in the base body, when the base body is installed on the chassis, the base body covers the installing groove, and the heating device is communicated with the breathable part of the waterproof and breathable membrane; and wherein a thickness of the waterproof and breathable membrane is larger than or equal to a depth of the installing groove and when being installed on the chassis, the base body abuts against the anti-wrinkle ring to press the waterproof and breathable membrane into the installing groove.

2. The atomizing device of the electronic cigarette according to claim 1, wherein the thickness of the waterproof and breathable membrane is equal to the depth of the installing groove, and the waterproof and breathable membrane further comprises an adhesive layer, the adhesive layer is provided on a surface of the base material facing away from the anti-wrinkle ring, so that the base material is adhered to an inner groove wall of the installing groove.

3. An electronic cigarette, wherein the electronic cigarette comprises the atomizing device of the electronic cigarette, wherein the atomizing device comprises a main body, a heating device and a waterproof and breathable membrane, wherein the main body is provided with an air inlet, a suction port and an oil storage chamber, the main body forms an airflow channel between the air inlet and the suction port, the heating device is partially received in the airflow channel and is communicated with the oil storage chamber, the waterproof and breathable membrane is installed on the main body, and the waterproof and breathable membrane covers the airflow channel between the air inlet and the heating device;

wherein the waterproof and breathable membrane comprises a base material with waterproof and breathable properties and an anti-wrinkle ring, the anti-wrinkle ring covers a edge of the base material so that when the base material is installed on the main body, a part of the base material not covered by the anti-wrinkle ring covers the airflow channel and forms a breathable part, and the breathable part is communicated with the airflow channel through the air path;

wherein the main body comprises a base body and a chassis: the air inlet is provided on the chassis, the airflow channel forms an air passage hole communicated with the air inlet on an outer surface of the chassis, the chassis is further provided with an installing groove on a periphery of the air passage hole, the waterproof breathable membrane is installed in the installing groove, and the breathable part of the waterproof breathable membrane covers the air passage hole so that the breathable part is communicated with the air passage hole through the air path; and the suction port, the oil storage chamber and the heating device are received in the base body, when the base body is installed on the chassis, the base body covers the installing groove, and the heating device is communicated with the breathable part of the waterproof and breathable membrane; and wherein a thickness of the waterproof and breathable membrane is larger than or equal to a depth of the installing groove, and when being installed on the chassis, the base body abuts against the anti-wrinkle ring to press the waterproof and breathable membrane into the installing groove.

4. The electronic cigarette according to claim 3, wherein the thickness of the waterproof and breathable membrane is equal to the depth of the installing groove, and the waterproof and breathable membrane further comprises an adhesive layer, the adhesive layer is provided on a surface of the base material facing away from the anti-wrinkle ring, so that the base material is adhered to an inner groove wall of the installing groove.

5. The electronic cigarette according to claim 3, wherein the difference between the thickness of the waterproof and breathable membrane and the depth of the installing groove is in a range from 1 mm to 2 mm, so that a maximum distance, in which the waterproof and breathable membrane is separated from the inner groove wall of the installing groove under an urging force of the airflow drawn through the air inlet, has a value of 1 mm to 2 mm; and/or a thickness of the base material has a value of 0.1 mm to 0.5 mm.

6. The electronic cigarette according to claim 3, wherein the chassis is further provided with at least one stopper, one end of the at least one stopper is fixed to the chassis and the other end thereof is placed in a notch of the installing groove, and the waterproof and breathable membrane abuts against the at least one stopper when moving outside the installing groove under the urging force of the airflow.

7. The electronic cigarette according to claim 3, wherein one of the waterproof and breathable membrane and the chassis is provided with a positioning member and the other of the waterproof and breathable membrane and the chassis is correspondingly provided with a positioning groove, and when the waterproof and breathable membrane is installed in the installing groove, the positioning member is inserted into the positioning groove.

* * * * *